US005617931A

United States Patent [19]

Zygmun et al.

[11] Patent Number: 5,617,931

[45] Date of Patent: Apr. 8, 1997

[54] MODULAR SCAFFOLDING SYSTEM

[75] Inventors: Leon E. Zygmun, Lake Forest; Martin C. Conneally, Downers Grove, both of Ill.

[73] Assignee: L. E. Zygmun and Company, Inc., Skokie, Ill.

[21] Appl. No.: 289,240

[22] Filed: Aug. 11, 1994

[51] Int. Cl.[6] ..... E04G 5/08

[52] U.S. Cl. ..... 182/145; 182/150

[58] Field of Search ..... 182/150, 145, 182/148, 142, 151

[56] References Cited

U.S. PATENT DOCUMENTS

| | | | |
|---|---|---|---|
| 2,008,081 | 7/1935 | Moussette, Sr. | 182/145 X |
| 2,057,092 | 10/1936 | Geib | 182/150 X |
| 2,662,734 | 12/1953 | Allenbaugh | 182/142 |
| 3,135,351 | 6/1964 | Economos et al. | 182/150 X |
| 4,048,059 | 9/1977 | Evans | 108/155 |
| 4,749,060 | 6/1988 | Vandelinde | 182/222 |

FOREIGN PATENT DOCUMENTS

| | | | |
|---|---|---|---|
| 486126 | 5/1992 | European Pat. Off. | 182/150 |
| 2119720 | 6/1981 | Germany | 182/150 |

OTHER PUBLICATIONS

Hi–Lo Climbers Brochure entitled "Suspended Powered Hoists for the Construction and Maintenance Industries".
Spider Staging Corporation Specifications for Modular Platforms.
Sky Climber, Inc. Catalog.
Sky Climber, Inc. Brochure on Modular Knock–Down Stage System.
Sky Climber, Inc. MKD Brochure.
Sky Climber, Inc. Sky Stage Brochure.
Sky Climber, Inc. Sky Climber Brochure.
Sky Climber, Inc. Specification Sheets for Sky Stage Type 505.
Sky Climber, Inc. Technical Data Sheets for The Modular Knock–Down Stage System.
Sky Climber Product List.
Altrex Brochure re "Modular suspended platform systems Type MHB".
Altrex Modular Platform Price List.
Modular Elements—Fabricated From Aluminum Alloy.
Brochure entitled "Suspended Platforms—Truly Modular Staging By Altrex".
Power Climber Brochure re PC1 Pocket Climber.
Diagram of Power Climber Modular Platform System.
Brochure re Griphoist Swingstage Modular Scaffold Platforms.
Swing Stage Brochure re Modular Staging.
Safeway Brochure re Modular Work Platforms.
Safeway Fall Arrest Equipment And Suspended Work Platforms User's Manual.
Sky–Hi Scaffolding Brochure re Swing Stages—Electric and Manual.

*Primary Examiner*—Alvin C. Chin-Shue
*Attorney, Agent, or Firm*—Fitch, Even, Tabin & Flannery

[57] ABSTRACT

A scaffold system having modular components including interconnectable side walls or side trusses having extruded upper and lower truss members, decks and various section connectors which are interchangeable simplifying transportation, minimizing storage and reducing inventory requirements. Single person set-up and take-down is provided in a modular scaffolding system allowing assembly of a vast array of configurations that accommodate various architectural shapes. Drop-in assembly of aluminum side trusses of modular scaffold sections with steel modular scaffold section connectors provides strong construction. Spring loaded latched are used to maintain decks in place at modular scaffold section connectors.

18 Claims, 5 Drawing Sheets

12
18
26
38
40
44
46
48
50
52
74
76
78
80
82
84
86
88
90
92
94
96
98

MODULAR SCAFFOLDING SYSTEM

BACKGROUND OF THE INVENTION

This invention relates to modular scaffolding systems for the construction and maintenance industries.

One example of a modular scaffolding system, shown in U.S. Pat. No. 4,749,060 to Vandelinde entitled "Modular Stage Platform" issued Jun. 7, 1988 employs preassembled stage platforms which are interconnected at their ends with male and female connectors comprising vertical plates extending at opposite ends of such platforms. The connections may be maintained with fasteners including cylindrical rods or connecting pins. The patent discloses a platform in which its side trusses and deck are welded together to form a large box-like structure which cannot be easily transported in a flattened state. Some scaffolding systems have detachable side trusses and decks so that the scaffolding may be transported in a flat, knock down state.

Since scaffolding systems are intended as temporary structures, they are repeatedly assembled, disassembled and moved from place to place, and are exposed to wear and tear during their lifetimes. Additionally, scaffolding is often handled roughly such that components are subject to impact loads and stress concentrations when loaded onto and off of trucks. In such environments, protruding members for interconnecting stage platforms such as male and female connectors located at the ends of the platforms are often problematic because such connectors are often bent or otherwise damaged making interconnection of platforms difficult or impossible, and possibly reducing their strength.

It is desirable that a modular scaffolding system be simple to put together using relatively few parts and flexible assembly procedures with few or no tools. Of course, scaffolding systems also must exhibit uncompromising strength under adverse working conditions. Many presently available scaffolding systems are heavy, cumbersome and hard to move from place to place such as that disclosed in U.S. Pat. No. 4,749,060. Many preassembled stage platforms are modular only to the extent that they are interconnectable with other stage platforms. Such scaffolding systems do not employ exchangeable and interchangeable modular componentry such as detachable side trusses and decks that may be transported in a flat stack on a bed of a pick-up truck and readily erected and connected to one another to form a scaffolding. Moreover, some such stage platforms have welded joints which are subject to undesirably high shear and tensile stresses.

SUMMARY OF THE INVENTION

In accordance with the present invention, an embodiment is described herein employing modular components used within a strong, lightweight modular scaffolding system. The described embodiment, however, is not intended as limiting the inventive teachings which, of course, are determined according to the appended claims. Modular scaffold sections, including side trusses and decks of various sizes and shapes are interconnectable using modular scaffold section connectors. The scaffolding system of the present invention includes sectional interchangeability and simple piece part replacement or add-ons. The present invention provides maximum efficiency with a design approach allowing the user to assemble systems easily in a vast array of configurations to conform to a wide variety of structural formations.

Separate side wall, deck and connector elements simplify transportation, minimize storage and reduce inventory requirements. Single person set-up and take-down with various length sections, e.g. 2, 4, 6, 8 and 10-foot sections, allows stage lengths up to 40 feet with 1000 pound loads, without regard to section sequencing or the placement of such various length sections within the modular scaffolding system. Furthermore, standard corner sections of 30 degrees, 45 degrees, 60 degrees and 90 degrees can be assembled to conform to virtually any shape.

The side trusses and deck are constructed of lightweight aluminum upper and lower truss members, these truss members being specially designed extrusions for withstanding shear loads from the supporting connecting pins under tension while resisting buckling in the horizontal plane. Lower truss member extrusions additionally provides for deck positioning and support. By utilizing a combined aluminum and steel construction, overall system weight is kept to a minimum. Lightweight aluminum sections are easily transported and can be stored in a limited floor space. The described embodiment provides strong, extruded aluminum truss members and incorporate a toe board for safety. The trusses are drop-in connectable to steel modular scaffold section connectors and secured in place with a pin and lanyard. Decks are then dropped into place, supported by a specially designed extruded aluminum truss member and latched at the modular scaffold section connector with spring loaded latches. The design concepts employed provide universal application, flexibility, safety, ruggedness and durability with superior strength-to-weight ratio.

The modular scaffolding section connectors and stirrup connectors for the attachment of a power unit such as an open breach reeving power hoist. The stirrup connectors may be located central to the section connections or along the side in a walk-through stirrup connector configuration. The section connectors have elongated link members including a drop-in opening for mating with a pin permanently mounted at the ends of the lower truss members. The upper elongated link members are for receiving upper truss member connecting pins for securing the truss in position at the ends of the upper truss members.

Briefly, the present invention relates to a scaffold system having modular components including interconnectable side trusses having extruded upper and lower truss members, decks and various section connectors which are interchangeable simplifying transportation, minimizing storage and reducing inventory requirements.

DETAILED DESCRIPTION OF THE PREFERRED EMBODIMENT

Figures 1, 2A, 2B, 2C, 2D:
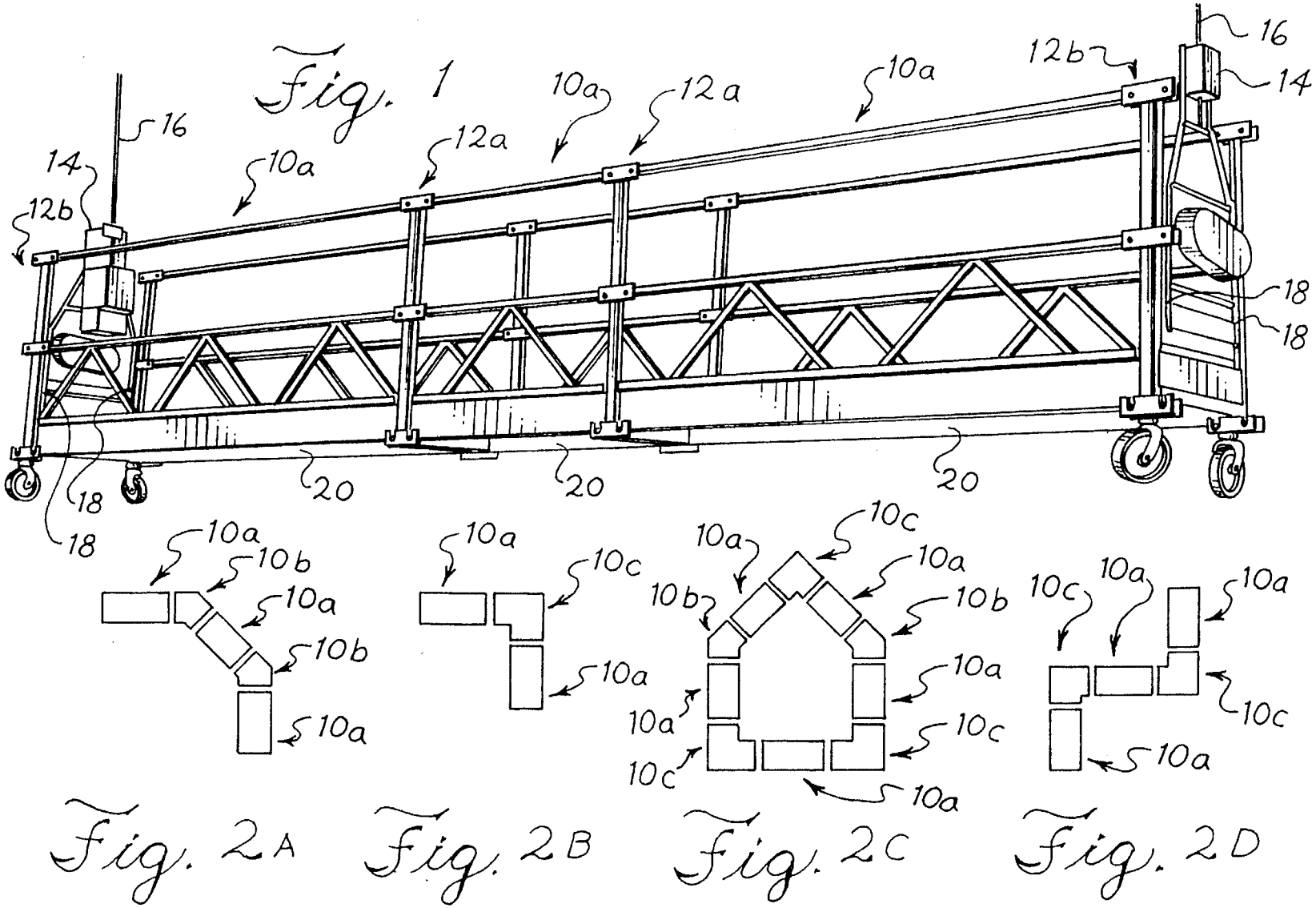
FIG. 1 a perspective view of a modular scaffold in accordance with the present invention in a linear configuration.
FIGS. 2A, 2B, 2C and 2D are schematic plan views illustrating modular scaffolds in four different alternative configuration.

The invention is generally embodied in a modular scaffolding system comprising a plurality of scaffold sections of different lengths and configurations which can be combined in various ways to meet the requirements of exterior building maintenance jobs on buildings of various different exterior configurations. FIG. 1 illustrates a short straight modular scaffold section 10*a* interconnected between two relatively longer straight modular scaffold sections 10*a*. The straight modular sections 10*a* are shown connected with modular scaffold section connectors 12*a*. Each section generally comprises a pair of side trusses 32 with a floor or deck 20 supported therebetween with a vertically adjustable guard rail on each side truss.

Modular scaffold section stirrup connectors 12*b* are provided at the ends of the modular scaffolding system of FIG. 1 as stirrup connectors which provide yokes for the connection of a power hoist 14 which draws wire rope or cable 16 therethrough. The preferred power hoist 14 is the Hi-Lo Climbers high speed Model FD-35I which provides open breach reeving in which the cable 16 is reeved therethrough allowing the power hoist 14 to climb the cable 16 thus elevating the scaffold. The Model FD-35I is modular, versatile and low maintenance and easily installed on the stop lock bracket 18 of the modular scaffold stirrup connectors 12*b*. The Model FD-35I features a speed up to 35 feet per minute for up to a 1000 pound load.

FIGS. 2A, 2B, 2C and 2D graphically illustrate some of the many configurations which may be constructed with the modular scaffolding system described herein. FIG. 2A, for example, represents the interconnection of five modular scaffold sections 10*a* and 45-degree corner scaffold sections 10b designed to fit around the contours of bay windows, comprising two 45-degree corner sections 10*b* connecting three straight or linear sections 10*a*. FIG. 2B illustrates two straight sections 10*a* interconnected between a 90-degree modular scaffolding section 10*c* to fit along the corner of a building. FIG. 2C shows a combination of straight sections 10*a* with 90-degree and 45-degree corner sections 10*b* and 10*c* to form a house-shaped structure which may encompass a pentagonal tower or which may be used within a building to provide access to all sides of a chandelier or other ceiling structures. FIG. 2D shows three straight sections 10*a* of various lengths interconnected by two 90-degree corner sections 10*c*.

Figure 3:
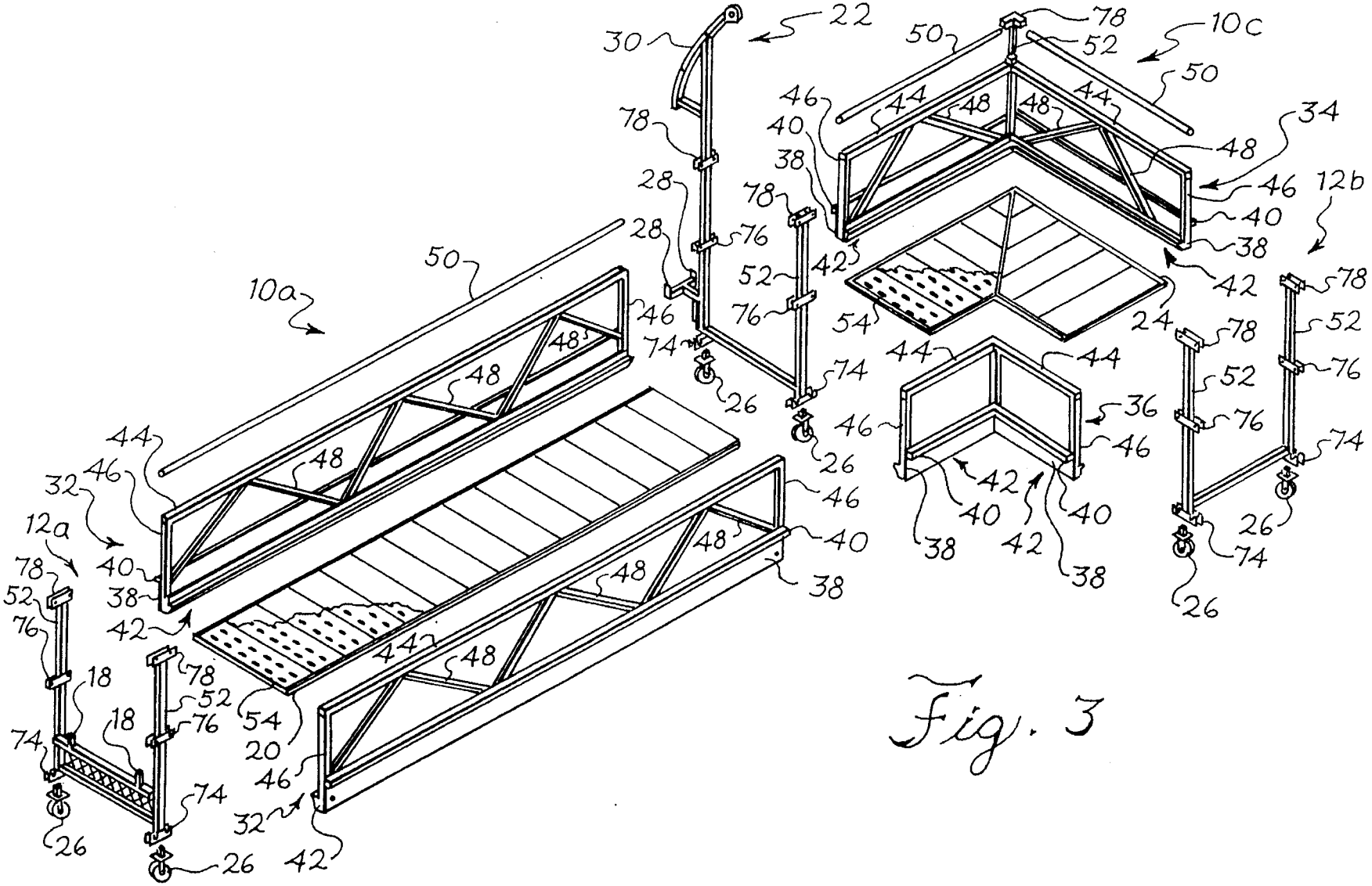
FIGS. 3 shows, in an exploded perspective view, portions of a modular scaffold in a further different alternative configuration.

Examples of the modular components are shown in greater detail in FIG. 3, which shows straight modular scaffold section 10*a* and a 90-degree corner section 10*c*. While only a straight and 90-degree modular scaffold corner section is shown, it should be noted that desirable lengths include 2, 4, 6, 8 and 10-foot straight sections and angled sections having standard corners of 30 degrees, 45 degrees, 60 degrees and 90 degrees.

The modular scaffold section assembly of FIG. 3 includes a straight deck 20 and an angled deck 24. The modular scaffold section connectors 12*a* illustrated with one modular scaffold section stirrup connector 12*b* having yokes 18. The former modular scaffold section connector 12*a* does not have the brackets 18. As discussed, the brackets 18 provide for the connection of the power hoist 14. The modular scaffold section connector 12*a* without the yokes 18 is preferred between intermediate modular scaffold sections allowing persons to walk therethrough.

When it is desired to walk through a modular scaffold section connector and also include a power hoist at the connector, a walk-through stirrup type modular scaffold connector 22 is employed which utilizes side mounted yokes 28. When a power hoist may thus be connected to the yokes 28 of the walk-through stirrup type modular scaffold connector 22, the cable 16 is extended through a top fairlead sheave 30 which employs pulley wheels and guides for routing the cable 16 therethrough. The top fairlead sheave extends upward and curves over the walkway of interconnected modular scaffold sections 10*a* and 10*c* allowing a person to walk therethrough from section to section of the modular scaffolding system of the embodiment. The modular scaffold connectors 12 and 22 may additionally provide for the connection of casters or wheels 26 allowing movement over ground surfaces, e.g. to position the scaffolding system.

A pair of side walls or side trusses 32 are shown as part of a straight modular scaffold section and angled side trusses 34 and 36 are used in the 90-degree angled modular scaffold section. A toe board 38 is provided along the lower outside side of the side trusses 32, 34 and 36. The toe board 38 extends upwardly from the bottom of the side truss about one-half foot and is reinforced by a toe board reinforcement rail 40.

An elongated lower truss member 42 and an elongated upper truss member 44 are supported between end beams 46 and a plurality of struts or web members 48 for supporting the elongated upper truss member 44 at a predetermined height over the elongated lower truss member 42. The web members 48 are shown as struts and may be affixed in a triangularized orientation for supporting the elongated lower truss member 42 and the elongated upper truss member 44.

Guard rails 50 may be elevated above the elongated upper truss member 44 and supported by adjustable guard rail supports 52 extendable from the modular scaffold section connectors 12 or at the corner of an angled modular scaffold section 10*c* as shown.

The deck 20 is supported between a pair of the side trusses 32. Likewise, the angled deck 24 is supported between angled side trusses 34 and 36. To prevent the deck 20 from being blown upward from wind, holes 54 are provided therein, and, as discussed below in connection with FIGS. 4A and 4B, the deck 20 is also latched at modular scaffold section connectors 12 to prevent movement. According to safety standards, the holes 54 may not be so large as permit a ball larger than 9/16 inch to pass through the holes 54.

Figure 3A:
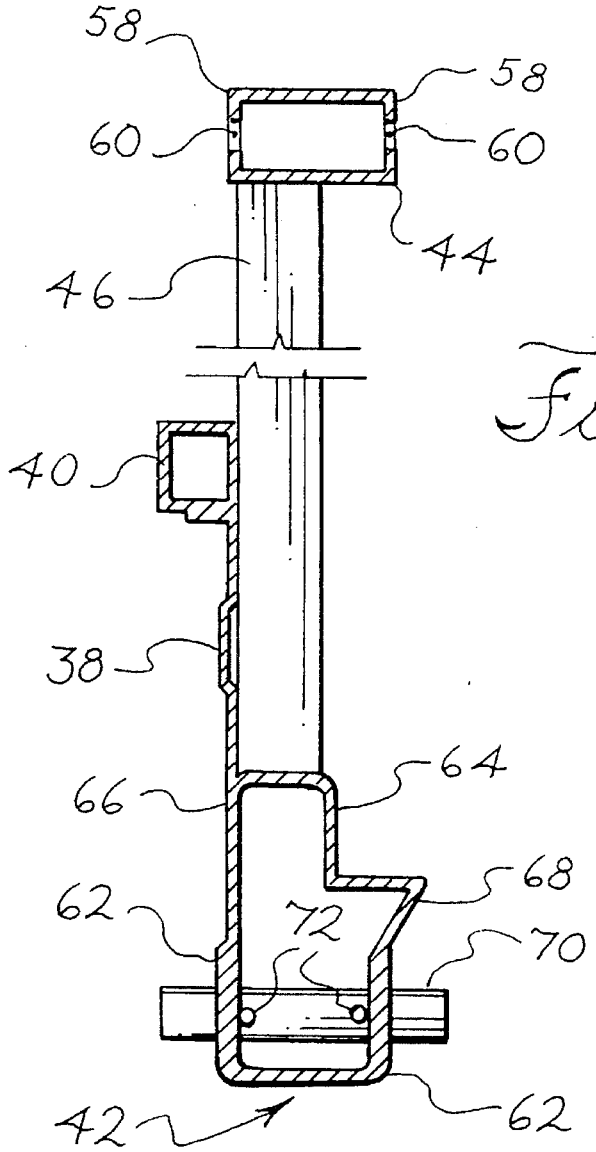
FIG. 3A is a foreshortened end view of a modular side truss member.

In FIG. 3A a foreshortened end view of the elongated upper truss member 44 shows an end view wherein the cross-section of the upper truss member 44 is rectangular (wider than tall); added width is provided to prevent buckling in a horizontal plane. The side walls 58 are reinforced with additional material such that holes 60 provided at the ends of the elongated upper truss members withstand shear loads from supporting pins under tension when the upper truss member 44 ends are connected to a modular scaffold section stirrup connector 12*b* or walk-through stirrup section connector 22.

The end view of FIG. 3A showing the end of the elongated lower truss member also shows added material at the bottom thereof at 62 providing thickened side walls similar to that on the upper truss member 44 to resist shear loads from supporting connecting pins under tension. The elongated truss member 42 thus provides a reinforced elongated U-shaped channel having a pair of vertical webs extending from a horizontal web. Further, the elongated truss member 42 also provides an elongated L-shaped member 64 having a vertical web for positioning the deck 20 and a horizontal web for supporting the deck 20. A web member sill 66 is provided for connecting plural side truss web members 48 and ends 46 thereto and for connecting the U-shaped channel walls 62 to the L-shaped member 64. A deck support sill 68 is provided for connecting the U-shaped channel side wall 62 to the horizontal web of the L-shaped member 64. The toe board 38 and reinforcement rail 40 are extruded as an integral member with the elongated truss member 42.

A lower truss member connecting pin 70 is shown locked in place by roll pins 72. This locked pin 70 allows drop-in placement at the ends of elongated link members 74 having a recess therein for receiving the pin 70 at the lower end of modular scaffold section connectors 12 and 22. The elongated link members 74 are made of steel, as such they provide for strong connections and avoid shear at welded areas where scaffolding sections are interconnected.

The elongated lower truss member 42 and the elongated upper truss member 44 may, of course, be composed of any appropriate material providing structural support and strength, but in this preferred embodiment extruded aluminum is utilized. The truss members 42 and 44 with the described pin connections facilitate the drop-in interconnection at the lower truss member 42 ends and the pinning connection at the ends of the elongated upper truss member 44. Thus, the extrusions described herein facilitate easy set-up and take-down of the described modular scaffolding system.

Upper elongated link members 76 are provided for receiving pins therethrough and through the ends of the elongated upper truss members 44. The described pin-link interconnections provide an easily assembled and strong fastening scheme. Additionally, elongated link members 78 provide for connection to guard rail 50.

Figures 4A, 4B:
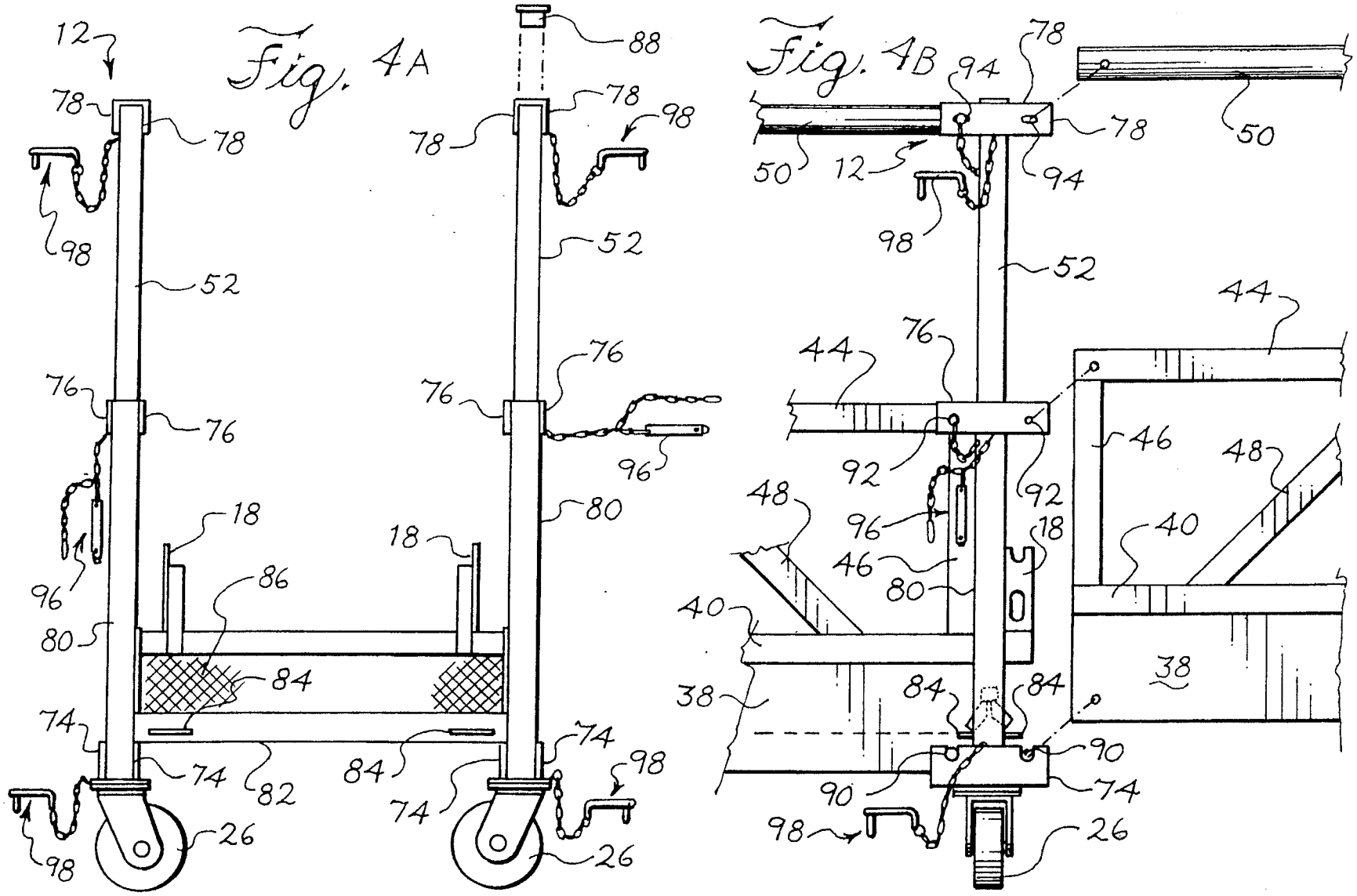
FIG. 4A is a front elevational view of a modular scaffold section connector including stirrups for mounting a power hoist.
FIG. 4B is a side elevational view of the modular scaffold section connector.

FIGS. 4A through 4F and particularly FIGS. 4A and 4B illustrate the various aspects of the modular scaffold section stirrup connector 12*b* in detail. The modular scaffold section connector 12 is made of zinc-plated steel and includes a pair of upstanding support members 80 connected to a base support member 82. End supports 84 are connected to the base member 82 for supporting the deck 20 at its ends. A meshed metal screening 86 is provided between the base member 82 and the brackets 18 when employing stirrups 18 with the modular scaffold section stirrup connector 12*b*. The adjustable guard rail post 52 extends into the upstanding support members 80 and a cap 88 may be provided at the top thereof.

In FIG. 4B the open U-shaped recess 90 at the ends of the lower elongated link members 72 is shown. The recess 90 receives the pin 70 of the elongated lower truss member to facilitate drop-in connection and fastening thereof. Pin connection holes 92 are provided at the ends of the upper elongated link member 76 and elongated holes 94 are provided in the link 78 for the adjustable guard rail 50. A pin and lanyard assembly 96 is provided for connection of the upper truss member 44 and gravity pins 98 are provided for connection of the guard rail 50 and safety support of the wheels 26.

FIG. 4B further illustrates side trusses 32 connected with the section stirrup connector 12*b*. Of course, typically the section stirrup connector 12*b* is at the end of a scaffold but it may be positioned intermediate the scaffold as shown. The arrows illustrate the way in which the side truss 32 may be dropped into position and then fastened to the section stirrup connectors.

The enlarged views in FIGS. 4C, 4D, 4E and 4F illustrate the drop-in interconnections of the side trusses 32 and the spring loaded latches for securing the deck 20. The latch assembly includes pivot bars 100 attached to an anchoring plate 102 which is mounted with a roll pin 104. The pivot bars 100 extend over the deck 20 and rotate about a hole 106. A latch spring 108 connected to the opposing ends of the pivot bars 100 cause the pivot bars 100 to extend outwardly. A cover 110 shown in dashed lines covers the latched spring and top portions of the pivot bars 100. A roll pin 112 acts as a stop for the pivot bars 100. When the deck 20 is dropped into place into a modular scaffold section, the pivot bar 100 moves inward and then outwardly to secure the deck 20 into position. To remove the deck 20 the pivot bar 100 is simply pushed inward allowing the deck 20 to be removed.

Figure 4C:
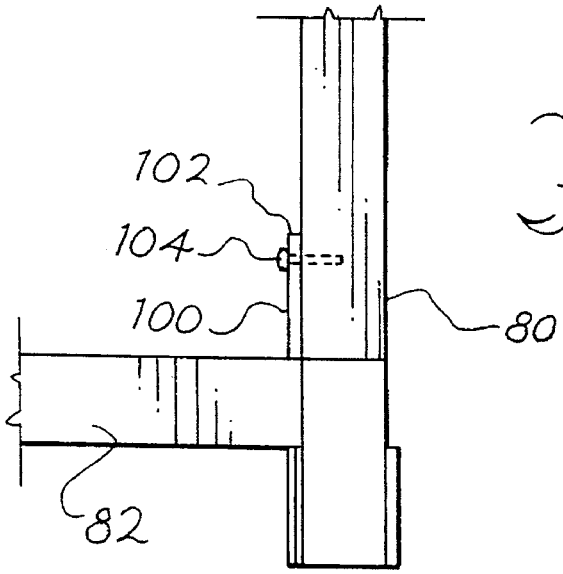
FIG. 4C is an enlarged view of a spring latched pivot bar for securing a scaffold deck in position.
Figure 4D:
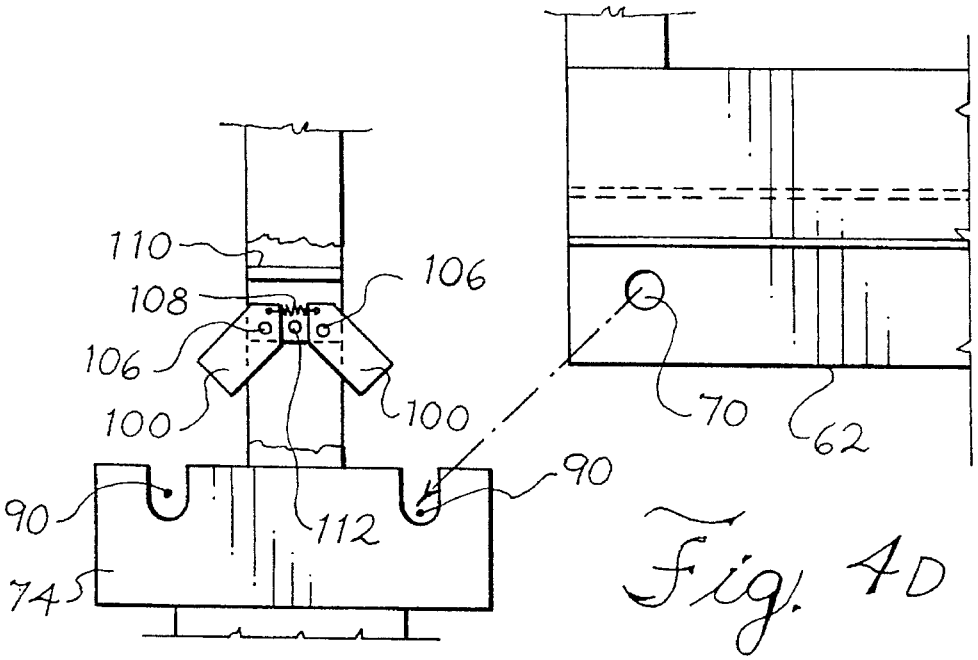
FIG. 4D shows the drop-in connection of the lower elongated truss member with a U-shaped recess of the lower elongated link member.
Figure 4E:
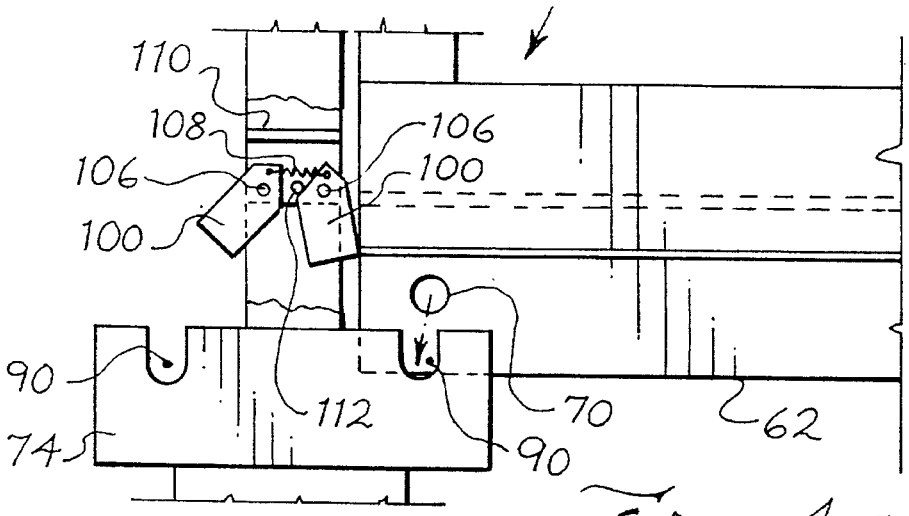
FIG. 4E shows the truss positioned over the link member.
Figure 4F:
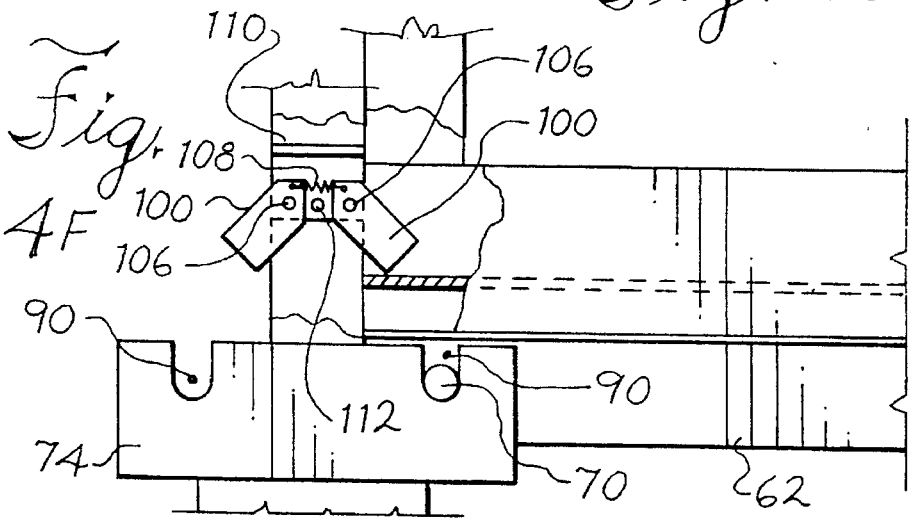
FIG. 4F shows the truss dropped into position with the deck locked with the spring latched pivot bar.

In FIG. 4C an enlarged view of the spring latched pivot bar 100 is shown. The pivot bar 100 is provided for securing a scaffold deck in position. FIG. 4D shows the drop-in connection of the lower elongated truss member connecting pin 70 with a U-shaped recess 90 of the lower elongated link member 74. FIG. 4E shows the truss and connecting pin 70 positioned over the elongated lower link member 74. FIG. 4F shows the truss dropped into position with the deck locked with the spring latched pivot bar 100.

While an embodiment has been described to illustrate concepts of the invention, other embodiments of modular scaffolding systems in accordance with the present invention will be apparent to those skilled in the art from consideration of the specification and practice of the invention disclosed herein. It is intended, therefore, that the specification be considered only exemplary with the true scope and spirit of the invention being indicated by the following claims.

What is claimed is:

1. In a modular scaffolding system to be assembled from a plurality of detachable sections, the combination comprising:

a first side wall of substantially flat, elongated shape;

a second side wall of substantially flat, elongated shape;

a detachable deck of substantially flat, elongated shape;

means on the first and second side walls for support said deck;

at least one end connector assembly for attachment to the ends of the first and the second side walls;

means for interconnecting the first side wall and the second side wall including drop-in pins and slotted connectors therebetween; and latch means for latching said deck; wherein said latch means comprise:

pivoted latches; and springs attached to said pivoted latches.

2. A system in accordance with claim 1 wherein said latch means is mounted on said interconnecting means.

3. A system in accordance with claim 1 wherein said pivoted latches are maintained over said deck by said springs.

4. In a modular scaffolding system to be assembled from a plurality of detachable sections, the combination comprising:

a first side wall of substantially flat, elongated shape;

a second side wall of substantially flat, elongated shape;

a detachable deck of substantially flat, elongated shape;

means on the first and second side walls for supporting said deck;

at least one end connector assembly for attachment to the ends of the first and the second side walls; and means for interconnecting the first side wall and the second side wall including drop-in pins and slotted connectors therebetween;

each of said slotted connectors including upstanding walls having open U-shaped recesses therethrough for receiving the drop-in pins;

said means for supporting the deck comprising inwardly protecting shoulders on said side walls allowing the edges of said deck to rest thereon, said shoulders comprising aluminum extrusions having integral ledges;

wherein said drop-in pins are permanently affixed at the end of said aluminum extrusions.

5. A modular scaffolding system comprising:

a plurality of modular scaffold sections each comprising a pair of side trusses each comprising an elongated upper member, an elongated lower truss member, a plurality of struts for supporting said elongated upper truss member at a predetermined height over said elongated lower truss member, and a toe board extending upward from said elongated lower truss member partially along said plurality of web members, and a deck for supporting persons and objects thereon, said deck being of a predetermined width and of length substantially as long as the elongated lower truss members of said pair of trusses, said elongated lower truss member comprising a reinforced elongated U-shaped channel having a pair of vertical webs extending from a horizontal web, said elongated lower truss member comprising an extrusion, said vertical webs having greater thickness than said horizontal web, an elongated L-shaped member for supporting said deck at the base thereof, a web member sill for connecting plural side truss web members thereto and for connecting said U-shaped channel to said L-shaped member, and a deck support sill for connecting said U-shaped channel to the horizontal web of said L-shaped member;

said pair of trusses being positionable upright with said deck therebetween supported along said elongated lower truss members of said pair of trusses;

upper truss member connecting pins extending transversely through the ends of each elongated upper truss member with their ends protruding laterally therefrom;

lower truss member connecting pins extending transverely through the ends of each elongated lower trus member with their ends protruding laterally therefrom;

a plurality of modular scaffold section connector assemblies for interconnecting said modular scaffold sections, each comprising a generally U-shaped frame having a base support member substantially as long as the width of said deck and a pair of upstanding support members, a plurality of upper elongated link members on said upstanding support members for joining adjacent modular scaffold sections, and a plurality of lower elongated link members on said upstanding support members near the base support member for joining adjacent modular scaffold sections, said upper elongated link members defining means at the ends thereof for receiving said upper truss member connecting pins therethrough, and said lower elongated link members defining means at the ends thereof for receiving said lower truss member connecting pins therethrough.

6. A system in accordance with claim 5 wherein said elongated upper and lower truss members each comprise aluminum extrusions defining openings at the side wall ends thereof for receiving said upper and lower truss member connecting pins, said side walls resisting shear forces.

7. A system in accordance with claim 6 wherein said elongated lower truss member elongated L-shaped portion having a vertical web for positioning said deck and a horizontal web for supporting said deck.

8. A system in accordance with claim 7 wherein said lower truss member connecting pins are mounted in the ends of said elongated lower truss member, and said lower elongated link members defining upwardly opening slots at the ends thereof allowing for a drop-in connection of said elongated lower truss member with said lower elongated link members.

9. A system in accordance with claim 8 wherein said means for securing said upper truss member connecting pins comprises a pin and lanyard assembly.

10. A system in accordance with claim 9 wherein said plurality of web members comprise aluminum struts for supporting said elongated upper truss member at a predetermined height over said elongated lower truss member.

11. A system in accordance with claim 10 wherein said modular scaffold section connector comprises a spring loaded latch thereon to lock said deck in place.

12. A system in accordance with claim 11 wherein the base support member of said generally U-shaped frame comprise stirrup brackets for mounting a power hoist thereon.

13. A system in accordance with claim 11 wherein said modular scaffold connector assemblies comprise a top fairlead sheave connected at one of the upstanding support members of the generally U-shaped frame, and stirrup brackets connected at said one of the upstanding support members for mounting a power hoist thereon.

14. A system in accordance with claim 11 wherein the generally U-shaped frame and the upper and lower elongated link members of said modular scaffold connector assemblies comprise zinc-plated steel.

15. A system in accordance with claim 11 comprising adjustable guard rails over said elongated upper truss member connectable to said modular scaffold connector assemblies.

16. A lower side truss member and deck support in accordance with claim 12 wherein said lower truss member connecting pins are secured at the ends of the lower side truss member.

17. A method of assembling modular scaffolding comprising the steps of:

supporting a pair of elongated upper and lower side truss members between a first and a second modular scaffold section connector assembly each comprising a generally U-shaped frame having a base support member and a pair of upstanding support members, and upper and lower elongated link members, at least one of said link members having one or more drop-in slots therein;

securing a plurality of upper and lower truss member connecting pins connectable to the ends of each elongated upper and lower truss member allowing the upper. and lower truss member connecting pins to extend through the ends of each elongated upper and lower truss member and outward therefrom, said upper and lower truss member connecting pins being secured through the upper and lower truss member ends and the upper and lower elongated link member ends at least one of said pins being secured to one of said link members by insertion in one of said drop-in slots; and supporting a deck along the pair of elongated lower truss members, the pair of elongated lower truss members each including a reinforced elongated U-shaped channel having a pair of vertical webs extending from a horizontal web, an elongated L-shaped member having a vertical web for positioning the deck and a horizontal web for supporting the deck, a web member sill for connecting plural side truss web members thereto and for connecting said U-shaped channel to said L-shaped member, and a deck support sill for connecting said U-shaped channel to the horizontal web of said L-shaped member, the supported deck being capable of supporting persons and objects thereon;

wherein said securing step comprises dropping in the lower truss member connecting pins into the lower elongated link members on said upstanding support members;

said method further comprising the step of locking the deck with spring loaded latches at the ends of the deck.

18. A method in accordance with claim 17 comprising extending an adjustable guard rail above the supported elongated upper and lower side truss members.

* * * * *